US009344825B2

(12) United States Patent
Carroll

(10) Patent No.: US 9,344,825 B2
(45) Date of Patent: May 17, 2016

(54) AT LEAST ONE OF INTELLIGIBILITY OR LOUDNESS OF AN AUDIO PROGRAM

(71) Applicant: The Telos Alliance, Cleveland, OH (US)

(72) Inventor: Timothy J. Carroll, Lancaster, PA (US)

(73) Assignee: TLS CORP., Cleveland, OH (US)

( * ) Notice: Subject to any disclaimer, the term of this patent is extended or adjusted under 35 U.S.C. 154(b) by 218 days.

(21) Appl. No.: 14/167,479

(22) Filed: Jan. 29, 2014

(65) Prior Publication Data

US 2015/0215720 A1 Jul. 30, 2015

(51) Int. Cl.

| | |
|---|---|
| ***H04R 5/02*** | (2006.01) |
| ***H04S 3/00*** | (2006.01) |
| ***H04S 3/02*** | (2006.01) |
| *H04R 29/00* | (2006.01) |

(52) U.S. Cl.

CPC . *H04S 3/006* (2013.01); *H04S 3/02* (2013.01); *H04S 2400/01* (2013.01); *H04S 2400/03* (2013.01); *H04S 2400/13* (2013.01)

(58) Field of Classification Search

CPC ..... G10L 19/008; G10L 19/20; H04S 7/30; H04S 2400/11; H04S 2420/01; H04S 2420/07; H04S 2400/01; H04S 2400/03; H04S 5/00; H04S 2400/05; H04S 3/006; H04S 3/008; H04R 2205/022; H04R 5/02

USPC ..... 381/300, 307, 18, 1, 119, 56; 704/203, 704/205, 500; 369/4

See application file for complete search history.

(56) References Cited

U.S. PATENT DOCUMENTS

| | | | |
|---|---|---|---|
| 4,748,669 | A | 5/1988 | Klayman |
| 5,046,098 | A | 9/1991 | Mandell et al. |
| 5,892,830 | A | 4/1999 | Klayman |
| 7,729,775 | B1 | 6/2010 | Saoji et al. |
| 2004/0044525 | A1 | 3/2004 | Vinton et al. |
| 2005/0074127 | A1 | 4/2005 | Herre et al. |

(Continued)

FOREIGN PATENT DOCUMENTS

| | | |
|---|---|---|
| WO | 2011/069205 | 6/2011 |

OTHER PUBLICATIONS

Musch, Hannes, "Aging and sound perception: Desirable Characteristics of Entertainment Audio for the Elderly", from Audio Engineering Society, Convention Paper 7627, AES 125th Convention, San Francisco, CA, USA, Oct. 2-5, 2008, pp. 1-14.

(Continued)

*Primary Examiner* — Paul S Kim
*Assistant Examiner* — Norman Yu
(74) *Attorney, Agent, or Firm* — Renner, Otto, Boisselle & Sklar, LLP

(57) ABSTRACT

A system for improving intelligibility or loudness of an audio program includes an encoder that receives signals of the audio program including at least one of left/front and right/front or left and right signals that include some anchor components of the audio program and to downmix the received signals to obtain left downmix and right downmix signals. The system includes a decoder that upmixes the left downmix and right downmix signals to obtain a center upmix signal that includes a majority of the anchor components including at least some anchor components that were included in the left/front and right/front signals or the left and right signals. The system also includes a system output that provides the center upmix signal to process at least one of the signals of the audio program based on the center upmix signal to improve intelligibility or loudness of the audio program.

36 Claims, 7 Drawing Sheets

(56) References Cited

U.S. PATENT DOCUMENTS

| | | | | |
|---|---|---|---|---|
| 2010/0179808 | A1 | 7/2010 | Brown | |
| 2010/0296672 | A1* | 11/2010 | Vickers | H04H 60/04 381/119 |
| 2011/0119061 | A1* | 5/2011 | Brown | G10L 19/008 704/258 |
| 2014/0123166 | A1* | 5/2014 | Johnson | G10L 25/72 725/18 |

OTHER PUBLICATIONS

Vickers, Earl, "Frequency-Domain Two-to Three-Channel Upmix for Center Channel Derivation and Speech Enhancement", from Audio Engineering Society, Convention Paper 7917, AES 127th Convention, New York, NY, USA, Oct. 9-12, 2009, pp. 1-24.

Author Unknown, "White Paper HE-AAC Metadata for Digital Broadcasting", from Fraunhofer IIS, Fraunhofer Institute for Integrated Circuits IIS, dated Sep. 2011, pp. 1-17.

Leek, Marjorie R., Dorman, Michael F., Summerfield, Quentin, "Minimum spectral contrast for vowel identification by normal-hearing and hearing-impaired listeners", Received Feb. 26, 1986; accepted for publication Sep. 8, 1986, PACS numbers: 43.71.Es, 43.71.Ky, pp. 148-154.

Bunnell, H. Timothy, "On enhancement of spectral contrast in speech for hearing-impaired listeners", Received Jun. 29, 1989, revised May 7, 1990, accepted Aug. 21, 1990, PACS numbers: 43.72.Ew, 43.71.Ky, 43.66.Ts, pp. 2546-2556.

Extended European Search Report dated Aug. 10, 2015 for corresponding European application No. 15151272.0.

* cited by examiner

AT LEAST ONE OF INTELLIGIBILITY OR LOUDNESS OF AN AUDIO PROGRAM

BACKGROUND

Programs, such as those intended for television broadcast are, in many cases, intentionally produced with variable loudness and wide dynamic range to convey emotion or a level of excitement in a given scene. For example, a movie may include a scene with the subtle chirping of a cricket and another scene with the blasting sound of a shooting cannon. Interstitial material such as commercial advertisements, on the other hand, is very often intended to convey a coherent message, and is, thus, often produced at a constant loudness, narrow dynamic range, or both. Annoying loudness disturbances commonly occur at the point of transition between the programming and the interstitial material. Thus the problem is commonly known as the "loud commercial problem." Loudness annoyances, however, are not limited to the programming/interstitial material transition, but are pervasive within the programming and the interstitial material themselves.

Intelligibility issues arise when a component of the audio that is important for comprehension of the programming, also known as an anchor, is made inaudible or is overpowered by another component of the audio. Dialog is arguably the most common program anchor. An example is the broadcast of a tennis match on TV. A commentator narrates the action on the court while at the same time noise from the crowd and the competitors may be heard. If the crowd noise overpowers the narrator's voice, that part of the program, the narrator's voice, may be rendered unintelligible.

Processes addressing the loud commercial problem and intelligibility issues generally attempt to measure loudness and use this measurement to adjust audio signals accordingly to improve loudness and intelligibility. Conventional techniques for measuring loudness, however, may be unsatisfactory.

One technique for measuring loudness disclosed in U.S. Pat. No. 7,454,331 to Vinton et al., which is incorporated by reference herein in its entirety, measures the speech component of the audio exclusively to determine program loudness. This technique, however, may provide insufficient loudness measurement for programming that includes only minimal speech components. For programming that includes no speech components at all, loudness may remain unmeasured and thus unimproved.

Another conventional technique, in essence, measures loudness by measuring whatever component of the audio is the loudest for the longest period of time. This technique, however, may provide measurements that deviate from the intent of the programming or from human perception of loudness. This may be particularly true for programming that has wide dynamic range. For example, this technique may erroneously judge the loudness of a scene which contains the roaring sound of a jet flying overhead as too loud. This measurement may result in processing or adjustment of the audio program that, for example, may lower speech components of the audio to unintelligible levels.

SUMMARY

The present disclosure describes novel techniques for improving intelligibility and loudness measurement accuracy of audio programs.

Specifically, the present disclosure describes systems and methods for better isolating sounds that humans perceive in an audio program as anchors, which are components of the audio that humans perceive as indicating direction of, for example, action displayed in a TV or movie screen. Isolating sounds that humans perceive as anchors enables focused measurement of loudness and intelligibility of the program, which, in turn, allows for the processing of the program based on the anchor-based measurements to improve loudness and/or intelligibility.

The present disclosure also describes systems and methods whereby frequency and level processing is applied to certain components of front and rear (a.k.a. surround) audio channels to selectively enhance or diminish certain characteristics of the audio signals thus resulting in improved measurement accuracy and intelligibility. Separation of front channel and surround (a.k.a. rear) channel audio allows specific processing to be applied to each as required. Examples of processing include frequency and level equalization, often differing in type and style between the front and rear channels, but with the shared goal of preventing one component from overpowering another more important component.

The techniques disclosed here may find particular application in the fields of broadcast and consumer audio. These techniques may be applied to stereo audio or multichannel audio of more than two channels, including but not limited to common formats such as 5.1 or 7.1 channels. These techniques may be also be applied to systems which use channel based and/or object based audio to convey additional dimensions and reality. Examples of channel and object based audio can be found in the developing MPEG-H standard, or in the recently described Dolby AC-4 system.

BRIEF DESCRIPTION OF THE DRAWINGS

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1A:
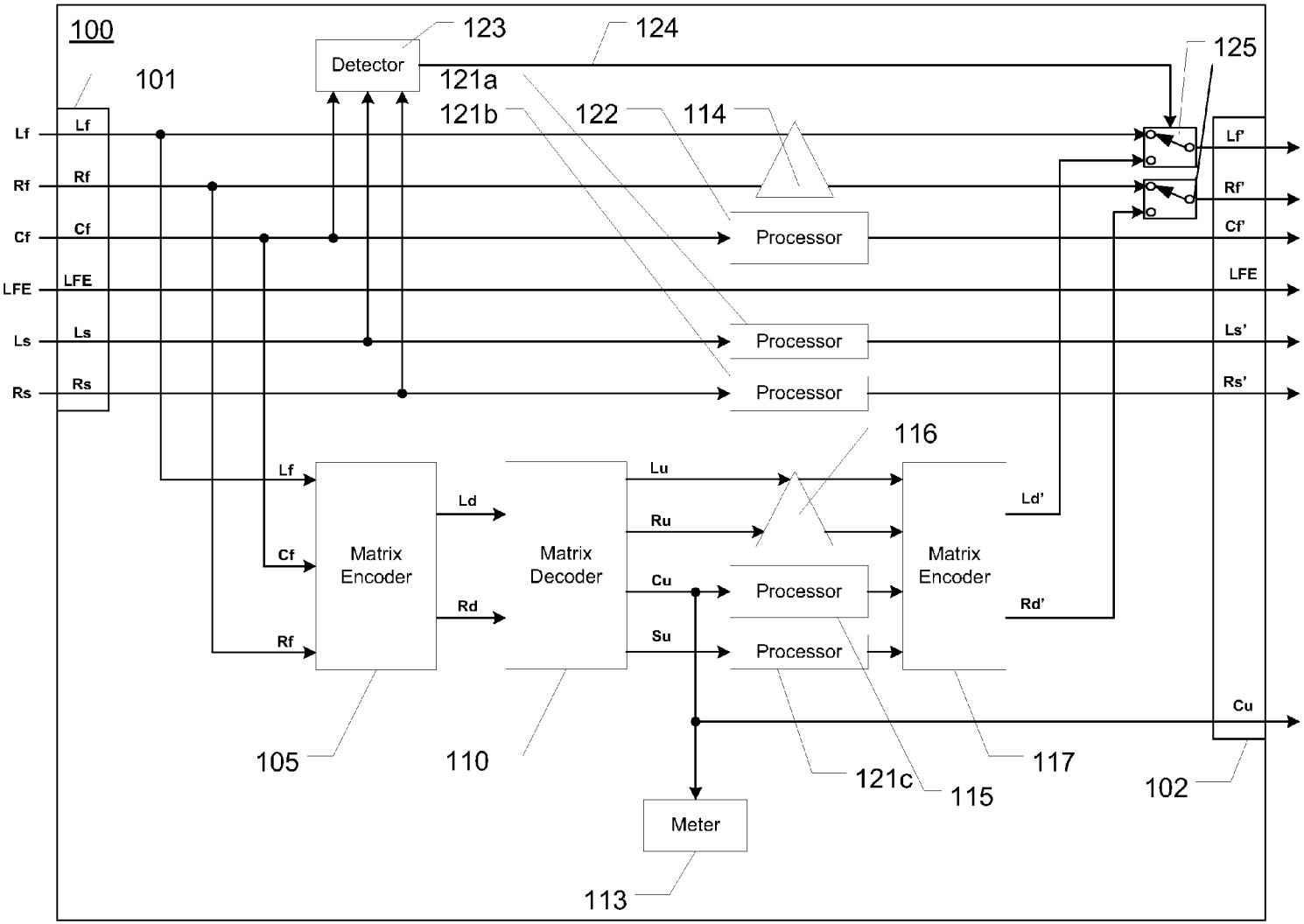
FIGS. 1A and 1B illustrate high-level block diagrams of an exemplary system for improving at least one of intelligibility or loudness of an audio program.
Figure 1B:
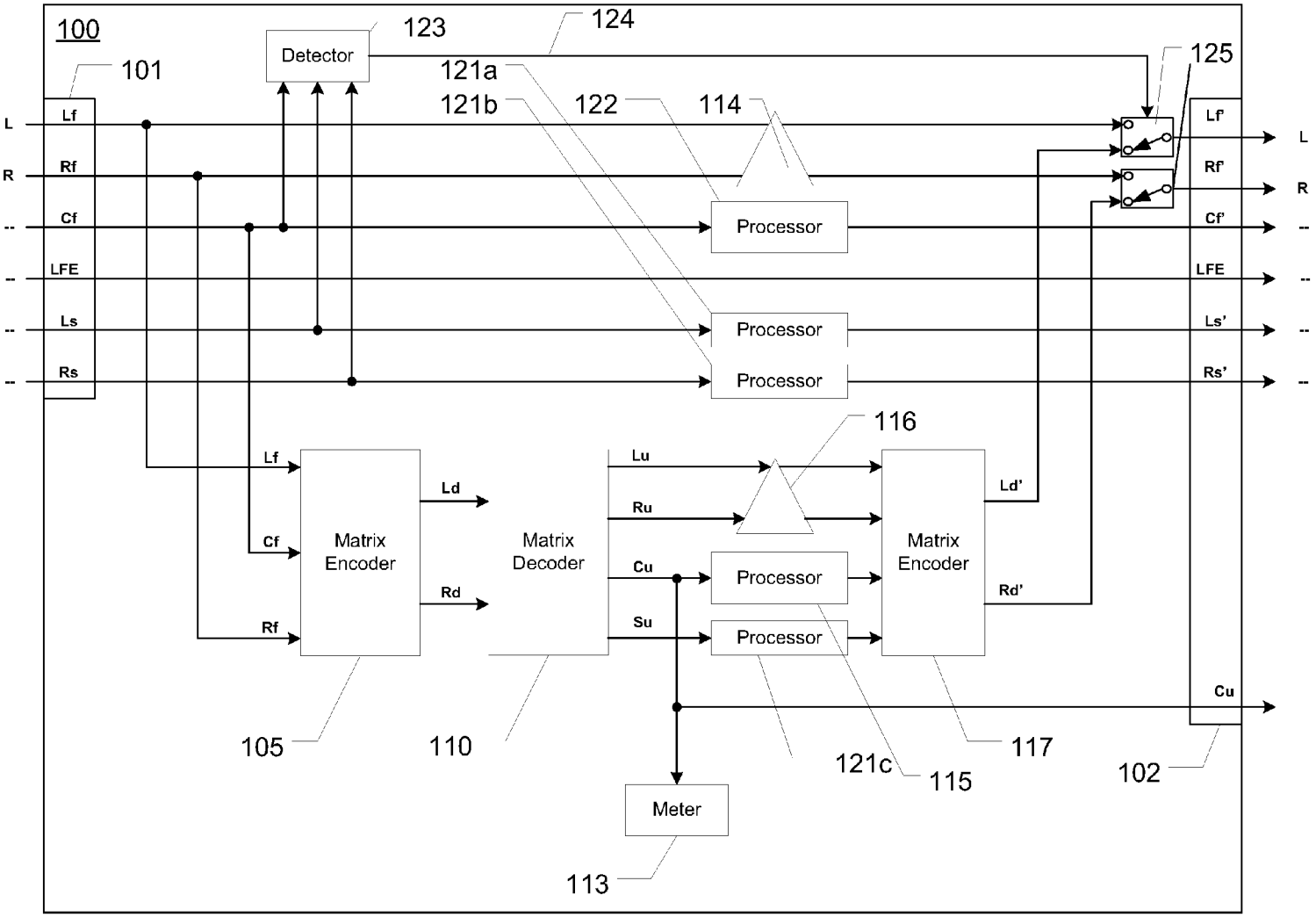

FIGS. 1A and 1B illustrate high-level block diagrams of an exemplary system 100 for improving at least one of intelligibility or loudness of an audio program.

The system 100 includes an input 101 that includes a set of terminals including left front Lf, right front Rf, center front Cf, low frequency effects LFE, left surround Ls, and right surround Rs corresponding to a 5.1 channel format. The system 100 also includes an output 102 that includes a set of terminals including left front Lf', right front Rf', center front Cf', low frequency effects LFE, left surround Ls', and right surround Rs' corresponding to a 5.1 channel format. While in the embodiments of FIGS. 1A and 1B the input 101 and the output 102 each includes six terminals corresponding to a 5.1 channel format, in other embodiments, the input 101 and the output 102 may include more or less than six terminals corresponding to formats other than a 5.1 channel format (e.g., 2-channel stereo, 3.1, 7.1, etc.)

In the embodiment of FIG. 1A the input 101 receives six signals Lf, Rf, Cf, LFE, Ls, and Rs. In the embodiment of FIG. 1B the input 101 receives two signals L and R.

The system 100 may include a detector 123 that detects whether at least one of the Cf, Ls, or Rs signals is present among signals of the audio program received by the input 101. That is, the detector 123 determines whether the audio program received by the input 101 is in a multichannel format (e.g., 3.1, 5.1, 7.1, etc.) or in a two channel (e.g., stereo) format. As described in more detail below, the system 100 performs differently depending on whether the audio program received by the input 101 is in a multichannel format or in a stereo format.

The present disclosure first describes the system 100 in the context of FIG. 1A (i.e., the detector 123 has determined that the audio program received at the input 101 is in a 5.1 multichannel format.)

The system 100 includes a matrix encoder 105 that receives the Lf, Cf, and Rf signals and encodes (i.e., combines or downmixes) the signals to obtain left downmix Ld and right downmix Rd signals. The encoder 105 may be one of many encoders or downmixers known in the art.

Figure 2:
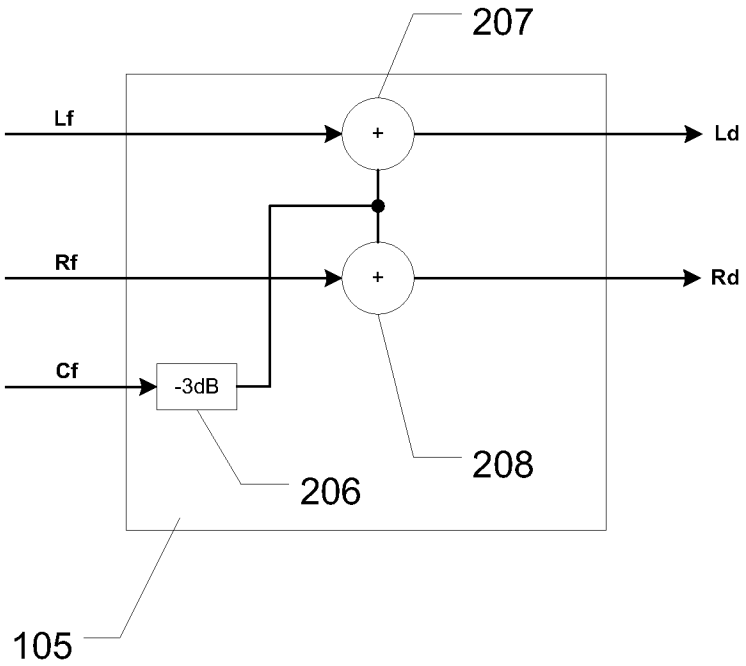
FIG. 2 illustrates a block diagram of an exemplary encoder.

FIG. 2 illustrates a block diagram of an exemplary encoder 105. In the embodiment of FIG. 2, the encoder 105 includes a gain adjust 206 and two summers 207 and 208. The gain adjust 206 adjusts the gain of the Cf signal (e.g., by −3 dB). The summer 207 sums Lf to the gain adjusted Cf signal to obtain Ld. The summer 208 sums Rf to the gain adjusted Cf signal to obtain Rd. The encoder 105 may be one of many encoders or downmixers known in the art other than the one illustrated in FIG. 2.

Returning to FIG. 1A, the system 100 includes a matrix decoder 110 that receives the Ld and Rd signals and decodes (e.g., separates or upmixes) the signals to obtain left upmix Lu, right upmix Ru, center upmix Cu, and surround upmix Su. The decoder 110 may be one of many decoders or upmixers known in the art an. An example of a decoder that may serve as the decoder 110 is described in U.S. Pat. No. 5,046,098 to Mandell, which is incorporated by reference herein in its entirety.

In one embodiment (not shown), the system 100 includes a matrix decoder that, instead of the surround Su signal, outputs left/surround upmix and right/surround upmix signals. In another embodiment (not shown), the system 100 includes a matrix decoder that does not output a surround upmix Su signal, but only Lu, Ru and Cu. In yet other embodiments, the system 100 includes a matrix decoder that center upmix Cu only.

Multichannel audio of more than two channels presents another challenge in the increasing use of so-called dialog panning where dialog may be present, in addition to the center front Cf channel, in the left front Lf and or right front Rf channels. This may require additional techniques to combine the Lf, Rf, and Cf channels prior to further decomposition and may result in the front dominant signals, including speech if present, to be directed primarily to one channel. For multichannel audio the above-described first downmix then upmix technique tends to direct any audio that is common between left front Lf and center front Cf and any audio that is common between right front Rf and center front Cf into just the center upmix Cu signal. Thus the resulting Cu signal includes the vast majority of the anchor elements even for programs in which the original left front Lf and/or right front Rf may also contain anchor elements (e.g., left to right/right to left dialog panning).

The system 100 may also include the processor 115 that may process the Cu signal to filter out information above and below certain frequencies that are not part of those frequencies normally found in dialog or considered anchors. The processor 115 may alternatively or in addition process the Cu signal to enhance speech formants and increase the peak to trough ratio both of which can improve intelligibility.

The Cu signal (or the processed Cu signal) may be provided via the output 102 for use by processes that may benefit from better anchor isolation. The Cu signal (or the processed Cu signal) may also be used to process at least one of the signals of the audio program based on the Cu signal to improve intelligibility or loudness of the audio program. For example, the Cu signal may be added to the Cf signal (not shown) to improve intelligibility of the audio program.

The system 100 may also include or be connected to a meter 113. The meter 113 may be compliant with a loudness measurement standard (e.g., EBU R128, ITU-R BS.1770, ATSC A/85, etc.) and the Cu signal (or the processed Cu signal) may be available as an input to the meter 113 so that loudness of the audio program may be measured very precisely. The output of the meter 113 may be used by processes that may benefit from better loudness measurement. The output of the meter 113 may also be used to process at least one of the signals of the audio program based on the Cu signal to improve intelligibility or loudness of the audio program.

As described above, detector 123 determines signal presence above threshold in the center front Cf, left surround Ls, or right surround Rs channels. If the detector 123 determines signal presence above threshold in the center front Cf, left surround Ls, or right surround Rs channels, the detector 123 may transmit a signal 124 to the switches 125 to allow left front Lf and right front Rf input audio to pass directly from input 101 to the output 102.

For the case of multichannel audio, the center front signal Cf often contains most of the dialog present in a program. Regarding the center front channel Cf, the system 100 may also include a processor 122 that processes the Cf signal.

Figure 3:
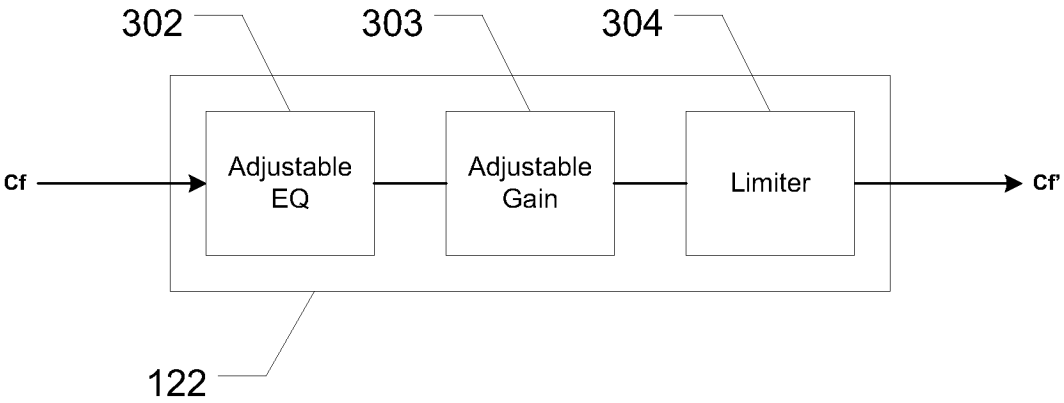
FIG. 3 illustrates a block diagram of an example processor that includes an adjustable equalizer, an adjustable gain and a limiter.

FIG. 3 illustrates a block diagram of an example processor 122 that includes an adjustable equalizer 302, an adjustable gain 303 and a limiter 304. The processor 122 therefore enables variable equalization, variable gain, and limiting to be applied to the center channel Cf. The adjustable equalizer (EQ) 302 such as a parametric equalizer may be used to modify the frequency response of the Cf signal. The variable gain stage 303 may apply positive or negative gain as desired. The limiter 304 such as, for example, a peak limiter may prevent audio from exceeding a set threshold before being output as Cf'. In one embodiment (not shown), one or more of the adjustable equalizer 302, the adjustable gain 303 and the limiter 304 is controlled based on the Cu signal such that the Cf signal is processed based on the Cu signal to, for example, improve intelligibility or loudness of the audio program.

Returning to FIG. 1A, for the case of multichannel audio, Ls and Rs often contain crowd noise, effects, and other information which may be out of phase and time alignment with the front channels Lf and Rf. Regarding the left surround Ls and right surround Rs signals, the system 100 may also include processors 121*a-b* that process the Ls and Rs signals.

Figure 4A:
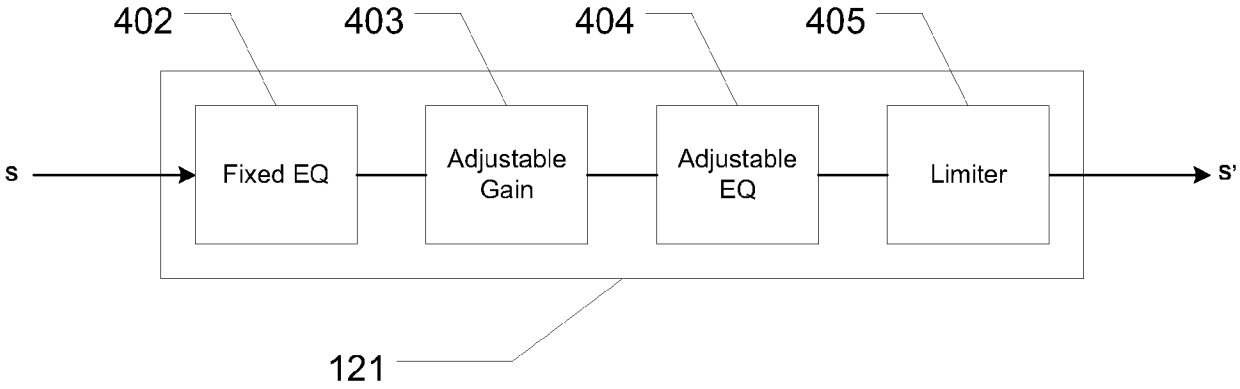
FIG. 4A illustrates a block diagram of an exemplary processor that includes a fixed equalizer that applies the frequency response shown in FIG. 4B.
Figure 4B:
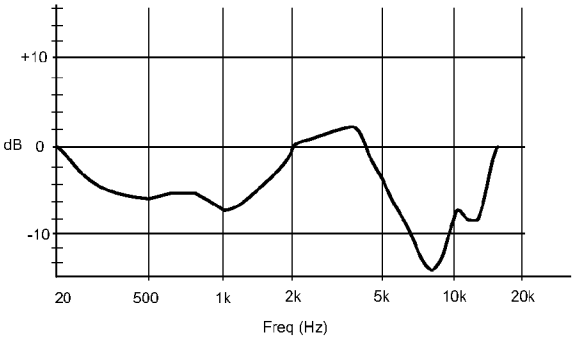
FIG. 4B illustrates the inverse frequency response of a filter that may be found in consumer equipment as part of a "hyper-surround" effect.

FIG. 4A illustrates a block diagram of an exemplary processor 121. The processor 121 includes a fixed equalizer (EQ) 402 that may be used to apply the frequency response shown in FIG. 4B which is the inverse frequency response of a filter that may be found in consumer equipment as part of a "hypersurround" effect. An example of such a "hypersurround" effect is described in U.S. Pat. Nos. 4,748,669 and 5,892,830 to Klayman, which are incorporated by reference herein in their entirety. The EQ402 may be followed by a variable gain stage 403 which can apply positive or negative gain as desired. The frequency response of this signal may also be modified by an adjustable equalizer (EQ) 404 such as a parametric equalizer, and a limiter 405 such as a peak limiter to prevent audio from exceeding a set threshold.

Back to FIG. 1A, the system 100 may also include a delay 114 that works in conjunction with one or more of the processors 121*a-b* and 122 to delay the Lf and Rf signals to compensate for any delays introduced in the Cf', Ls' and Rs' signals by the processors 121*a-b* and 122.

The present disclosure now describes the system 100 in the context of FIG. 1B (i.e., the detector 123 has determined that the audio program received at the input 101 is in a two-channel stereo format.) Multichannel signals of more than two channels, such as in formats of 5.1 or 7.1 channels, already have the front and surround channels separated, but two channel stereo content has the front and rear information combined and thus requires additional processing.

As discussed above, in the embodiment of FIG. 1B the input 101 receives two signals L and R. The matrix encoder 105 receives the L and R signals and outputs left downmix Ld and right downmix Rd signals, which are then passed to the matrix decoder 110. In this case, however, since a one-to-one relationship exists between inputs and outputs signals, the L and R signals may simply be passed through encoder 105 as the Ld and Rd signals, respectively. In one embodiment (not shown), the system 100 does not include the encoder 105 and the L and R signals are passed directly as the Ld and Rd signals to the matrix decoder 110.

The matrix decoder 110 receives the Ld and Rd signals and decodes (e.g., separates or upmixes) the signals to obtain left upmix Lu, right upmix Ru, center upmix Cu, and surround upmix Su. The simplest method to accomplish front/rear separation in two channel stereo signals is by creating L+R, or Front, and L−R, or Rear audio signals. However, applying correction individually to just these signals may result in undesired audible artifacts such as stereo image narrowing. Through the use of matrix decoding or upmixing, further decomposing the front and surround into left front upmix Lu, center upmix Cu, right front upmix Ru, and surround upmix Su (or left surround and right surround) enables more finely grained control to be applied. Further decomposing the front and surround into left front upmix Lu, center upmix Cu, right front upmix Ru, and surround upmix Su (or left surround and right surround) also further isolates Cu, which often contains the dialog or other anchor portions of a program.

The Cu signal (or the Cu signal processed by the processor 115 to filter out frequencies of the Cu signal that are not part of those frequencies normally found in dialog or considered anchors or to enhance speech formants or increase the peak to trough ratio) may be output via the output 102 for use by processes that may benefit from better anchor isolation. The system 100 may also include the meter 113 and the Cu signal (or the processed Cu signal) may be available as an input to the meter 113 so that loudness of the audio program may be measured very precisely. The Cu signal (or the processed Cu signal) or the output of the meter 113 may also be used to process at least one of the signals of the audio program based on the Cu signal to improve intelligibility or loudness of the audio program. For example, the Cu signal may be added to the L and R signals to improve intelligibility of the audio program.

In another example and as illustrated in FIG. 1B, the Cu signal or the Cu signal as processed by the processor 115 may be applied to a second matrix encoder 117 together with the other outputs of the matrix decoder 110. In the embodiment of FIG. 1B, the Lu, Ru, Cu and Su signals are applied to matrix encoder or downmixer 117 to produce left downmix Ld' and right downmix Rd' signals.

Figure 5:
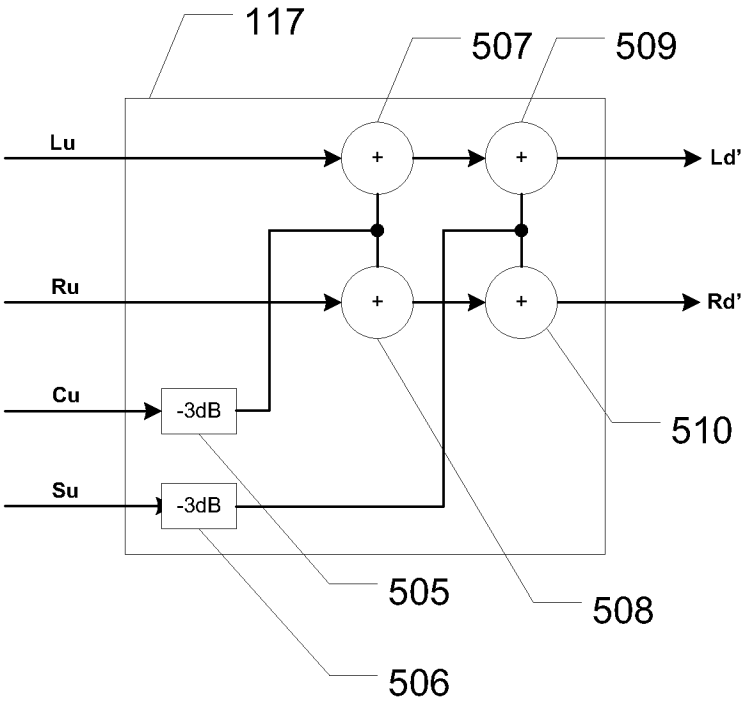
FIG. 5 illustrates a block diagram of an exemplary downmixer.

FIG. 5 illustrates a block diagram of an exemplary downmixer or encoder 117. In the embodiment of FIG. 5, the encoder 117 includes gain adjusts 505 and 506 that adjust the gain (e.g., by −3 dB) of the Cu signal and the Su signals, respectively. The encoder 117 also includes summers 507 and 509 that sum Lu to the gain adjusted Cu signal and the gain adjusted Su signal, respectively, to obtain Ld'. The encoder 117 also includes the summers 508 and 510 that sum Ru to the gain adjusted Cu signal and the gain adjusted Su signal, respectively, to obtain Rd'. The encoder 117 may be one of many encoders or downmixers known in the art other than the one illustrated in FIG. 5.

Returning to FIG. 1B, the decoder 110 may output a different number of signals from those shown. In those embodiments (not shown) in which the decoder 110 outputs more or less than the illustrated outputs Lu, Ru, Cu and Su (for example where the decoder 110 outputs only Lu, Ru and Cu or where the decoder 110 outputs left surround and right surround in addition to Lu, Ru and Cu), the outputs of the decoder 110 as applicable are applied to the encoder 117 to produce the left downmix Ld' and right downmix Rd' signals.

In one embodiment, the system 100 may also include the processor 121*c* that processes the Su signal. As described above, FIG. 4A illustrates a block diagram of the exemplary processor 121, which includes the fixed equalizer (EQ) 402 that may be used to apply the frequency response shown in FIG. 4B which is the inverse frequency response of a filter that may be found in consumer equipment as part of a "hypersurround" effect. The EQ 402 may be followed by a variable gain stage 403 which can apply positive or negative gain as desired. The frequency response of this signal may also be modified by an adjustable equalizer (EQ) 404 such as a parametric equalizer, and a limiter 405 such as a peak limiter to prevent audio from exceeding a set threshold.

The system 100 may also include a delay 116 that works in conjunction with one or more of the processors 121*c* and 115 to delay the Lu and Ru signals to compensate for any latency caused by the processors 121*c* and 115.

As described above, the detector 123 determines signal presence above threshold in the center front Cf, left surround Ls, or right surround Rs channels. If the detector 123 determines no signal presence above threshold in the center front Cf, left surround Ls, or right surround Rs channels (i.e., stereo), the detector 123 may transmit the signal 124 to the switches 125 to pass the Ld' and Rd' to the output 102.

Figure 6:
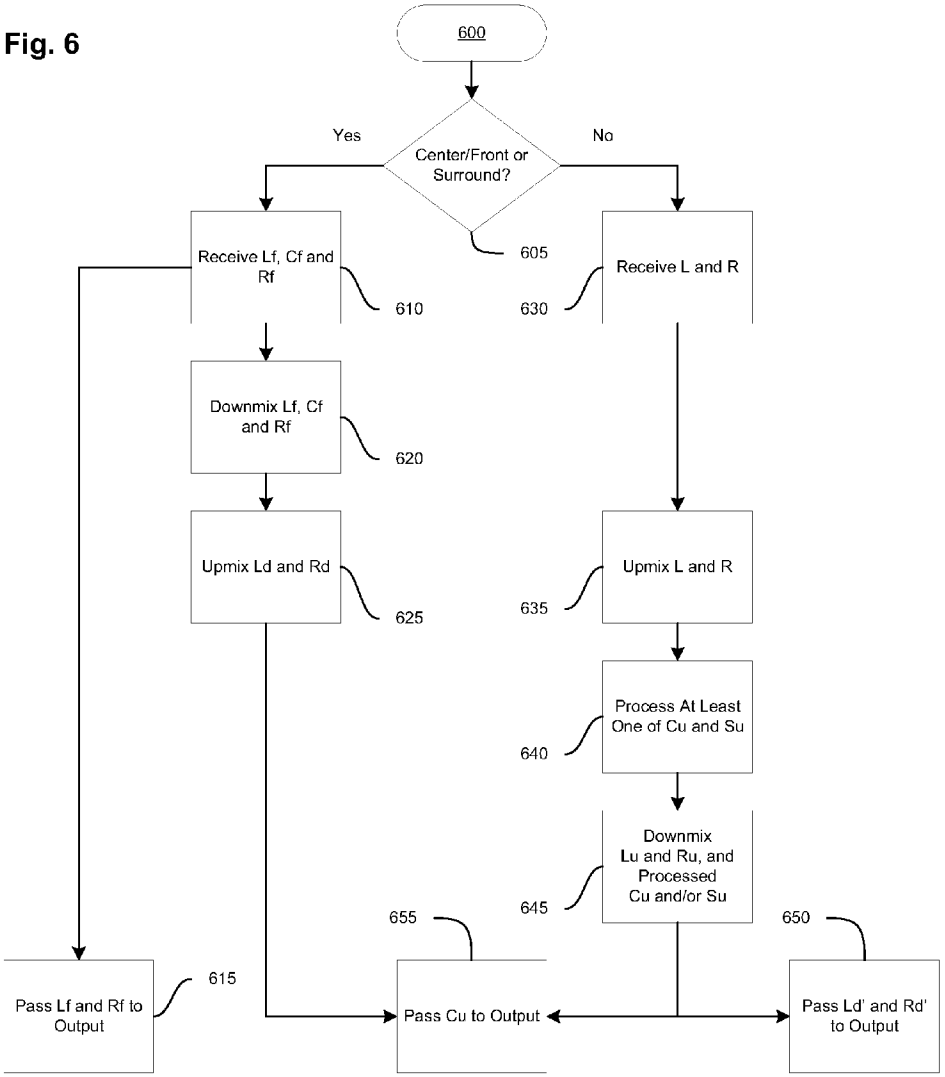
FIG. 6 illustrates a flow diagram for an example method for improving at least one of intelligibility or loudness of an audio program.

Example methods may be better appreciated with reference to the flow diagram of FIG. 6. While for purposes of simplicity of explanation, the illustrated methodologies are shown and described as a series of blocks, it is to be appreciated that the methodologies are not limited by the order of the blocks, as some blocks can occur in different orders or concurrently with other blocks from that shown and described.

Moreover, less than all the illustrated blocks may be required to implement an example methodology. Furthermore, additional methodologies, alternative methodologies, or both can employ additional blocks, not illustrated.

In the flow diagram, blocks denote "processing blocks" that may be implemented with logic. The processing blocks may represent a method step or an apparatus element for performing the method step. The flow diagrams do not depict syntax for any particular programming language, methodology, or style (e.g., procedural, object-oriented). Rather, the flow diagram illustrates functional information one skilled in the art may employ to develop logic to perform the illustrated processing. It will be appreciated that in some examples, program elements like temporary variables, routine loops, and so on, are not shown. It will be further appreciated that electronic and software applications may involve dynamic and flexible processes so that the illustrated blocks can be performed in other sequences that are different from those shown or that blocks may be combined or separated into multiple components. It will be appreciated that the processes may be implemented using various programming approaches like machine language, procedural, object oriented or artificial intelligence techniques.

FIG. 6 illustrates a flow diagram for an exemplary method 600 for improving at least one of intelligibility or loudness of an audio program. At 605, the method 600 includes detecting whether at least one of a center/front signal or a surround signal is present among signals of the audio program.

If at least one of the center/front or the surround signal is present among the signals of the audio program, at 610, the method 600 includes receiving the audio signals of the audio program including at least left/front, center/front and right/front signals each of which includes at least some anchor components of the audio program, and, at 615, passing the left/front and right/front signals to the output.

At 620, the method 600 includes downmixing the left/front, center/front and right/front signals to obtain left downmix and right downmix signals. At 625, the method 600 includes upmixing the left downmix and right downmix signals to obtain at least a center upmix signal. The center upmix signal includes a majority of the anchor components of the audio program including at least some anchor components of the audio program that were included in the left/front and right/front signals. At 655, the center upmix signal is passed to the output.

Back to 605, if at least one of the center/front or the surround signal is not present among the signals of the audio program, at 630, the method 600 includes receiving the audio signals of the audio program including at least left and right signals each of which includes at least some anchor components of the audio program. At 635, the method 600 includes upmixing the left and right signals to obtain at least the center upmix signal, which includes a majority of the anchor components of the audio program including at least some anchor components of the audio program that were included in the left and right signals. Along with the center upmix signal, the upmixing of the left and right signals may also produce left and right upmix signals and surround upmix signals (e.g., left and right surround upmix signals.)

At 640, the method 600 includes processing at least one of the center upmix signal or a surround upmix signal. For example, processing the center upmix signal or the surround upmix signal may include adjustably equalizing the center upmix signal or the surround upmix signal, adjustably varying the gain of the center upmix signal or the surround upmix signal, and limiting the center upmix signal or the surround upmix signal from exceeding a set threshold. Processing the surround upmix signal may also include equalizing the surround upmix signal to preprocess the signal with an inverse frequency response (see FIG. 4B) of a filter found in consumer equipment as part of a "hypersurround" effect.

At 645, the method 600 includes downmixing at least the left and right upmix signals and the processed center upmix signal or surround upmix signal to obtain left and right downmix signals in which at least one of intelligibility or loudness has been improved over intelligibility or loudness of the left and right signals. At 650, the method 600 passes the left and right downmix signals to the output. At 655, the method 600 also includes providing the center upmix signal as an output.

The center upmix signal may be used by an external process to process at least one of the signals of the audio program based on the center upmix signal to improve at least one of intelligibility or loudness of the audio program.

For example, the method 600 may include metering the center upmix signal to provide a value of intelligibility or loudness of the audio program that may serve as basis for processing at least one of the signals of the audio program to improve intelligibility or loudness of the audio program. The metering may be done in compliance with established standards such as EBU R128, ITU-R BS.1770, ATSC A/85, etc.

While FIG. 6 illustrates various actions occurring in serial, it is to be appreciated that various actions illustrated could occur substantially in parallel, and while actions may be shown occurring in parallel, it is to be appreciated that these actions could occur substantially in series. While a number of processes are described in relation to the illustrated methods, it is to be appreciated that a greater or lesser number of processes could be employed and that lightweight processes, regular processes, threads, and other approaches could be employed. It is to be appreciated that other example methods may, in some cases, also include actions that occur substantially in parallel. The illustrated exemplary methods and other embodiments may operate in real-time, faster than real-time in a software or hardware or hybrid software/hardware implementation, or slower than real time in a software or hardware or hybrid software/hardware implementation.

While example systems, methods, and so on, have been illustrated by describing examples, and while the examples have been described in considerable detail, it is not the intention of the applicants to restrict or in any way limit scope to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, the representative apparatus, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995).

The invention claimed is:

1. A method for improving at least one of intelligibility or loudness of an audio program, the method comprising:

detecting whether at least one of a center/front signal or a surround signal is present among signals of the audio program; and if at least one of the center/front or the surround signal is present among the signals of the audio program:

receiving the audio signals of the audio program including at least left/front, center/front and right/front signals each of which includes at least some anchor components of the audio program;

downmixing the left/front, center/front and right/front signals to obtain left downmix and right downmix signals; and upmixing the left downmix and right downmix signals to obtain at least a center upmix signal, which includes a majority of the anchor components of the audio program including at least some anchor components of the audio program that were included in the left/front and right/front signals; and if at least one of the center/front or the surround signal is not present among the signals of the audio program:

receiving the audio signals of the audio program including at least left and right signals each of which includes at least some anchor components of the audio program; and upmixing the left and right signals to obtain at least the center upmix signal, which includes a majority of the anchor components of the audio program including at least some anchor components of the audio program that were included in the left and right signals; and providing the center upmix signal to process at least one of the signals of the audio program based on the center upmix signal to improve at least one of intelligibility or loudness of the audio program.

2. The method of claim 1, comprising:

metering the center upmix signal to provide a value of intelligibility or loudness of the audio program.

3. The method of claim 2, comprising:

processing at least one of the signals of the audio program based on the value of intelligibility or loudness of the audio program to improve intelligibility or loudness, respectively, of the audio program.

4. The method of claim 2, wherein the metering is compliant with at least one of:

EBU R128;

ITU-R BS.1770; and

ATSC A/85.

5. The method of claim 1, comprising:

if at least one of the center/front or the surround signal is present among the signals of the audio program:

passing the left/front and right/front signals; and if at least one of the center/front or the surround signal is not present among the signals of the audio program:

obtaining at least the center upmix signal and left and right upmix signals from the upmixing of the left and right signals;

processing the center upmix signal, and downmixing at least the left and right upmix signals and the processed center upmix signal to obtain left and right downmix signals in which at least one of intelligibility or loudness has been adjusted over the left and right signals.

6. The method of claim 1, wherein the upmixing the left downmix and right downmix signals includes:

upmixing the left downmix and right downmix signals to obtain left and right upmix signals and at least one surround upmix signal that includes only non-anchor components of the audio program.

7. The method of claim 1, wherein the upmixing the left and right signals includes:

upmixing the left and right signals to obtain left and right upmix signals and at least one surround upmix signal that includes only non-anchor components of the audio program.

8. The method of claim 7, comprising:

processing at least one of the center upmix signal or the at least one surround upmix signal, wherein the processing includes at least one of:

equalizing the at least one surround upmix signal to preprocess the at least one surround upmix signal with an inverse frequency response of a filter found in consumer equipment as part of a hypersurround effect;

adjustably equalizing the center upmix signal or the at least one surround upmix signal;

adjustably varying the gain of the center upmix signal or the at least one surround upmix signal; and limiting the center upmix signal or the at least one surround upmix signal from exceeding a set threshold; and downmixing at least the left and right upmix signals and at least one of the processed surround upmix signal and the processed center upmix signal to obtain left and right downmix signals in which at least one of intelligibility or loudness has been adjusted over the left and right signals.

9. The method of claim 1, comprising:

processing the center/front signal to improve at least one of the intelligibility or the loudness of the audio program, the processing including at least one of:

adjustably equalizing the center/front signal;

adjustably varying the gain of the center/front signal; and limiting the center/front signal from exceeding a set threshold.

10. The method of claim 1, comprising:

processing at least one surround signal of the audio program, the processing including at least one of:

equalizing the at least one surround signal to preprocess the at least one surround signal with an inverse frequency response of a filter found in consumer equipment as part a hypersurround effect;

adjustably equalizing the at least one surround signal;

adjustably varying the gain of the at least one surround signal; and limiting the at least one surround signal from exceeding a set threshold.

11. A method for improving at least one of intelligibility or loudness of an audio program, the method comprising:

receiving audio signals of the audio program including at least left/front, center/front and right/front signals each of which includes at least some anchor components of the audio program;

downmixing the left/front, center/front and right/front signals to obtain left downmix and right downmix signals;

upmixing the left downmix and right downmix signals to obtain at least a center upmix signal that includes a majority of the anchor components of the audio program including at least some anchor components of the audio program that were included in the left/front and right/front signals;

providing the center upmix signal to process at least a center/front output signal based on the center upmix signal to improve at least one of intelligibility or loudness of the audio program including adding at least a portion of the center upmix signal to the center/front signal to obtain the center/front output signal to improve the intelligibility of the audio program.

12. The method of claim 11, comprising:

metering the center upmix signal to provide a value of intelligibility or loudness of the audio program.

13. The method of claim 12, comprising:

processing at least one of the signals of the audio program based on the value of intelligibility or loudness of the audio program to improve intelligibility or loudness, respectively, of the audio program.

14. The method of claim 12, wherein the metering is compliant with at least one of:

EBU R128;

ITU-R BS.1770; and

ATSC A/85.

15. The method of claim 11, wherein the upmixing the left downmix and right downmix signals includes:

upmixing the left downmix and right downmix signals to obtain left and right upmix signals and at least one surround upmix signal that includes only non-anchor components of the audio program.

16. The method of claim 11, comprising:

processing the center/front signal to improve at least one of the intelligibility or the loudness of the audio program, the processing including at least one of:

adjustably equalizing the center/front signal;

adjustably varying the gain of the center/front signal; and limiting the center/front signal from exceeding a set threshold.

17. A method for improving at least one of intelligibility or loudness of an audio program, the method comprising:

receiving audio signals of the audio program including at least left and right signals each of which includes at least some anchor components of the audio program;

upmixing the left and right signals to obtain at least a center upmix signal that includes a majority of the anchor components of the audio program including at least some anchor components of the audio program that were included in the left and right signals; and providing the center upmix signal to process left and right output signals based on the center upmix signal to improve at least one of intelligibility or loudness of the audio program including adding at least a portion of the center upmix signal to the left and right signals to obtain the left and right output signals to improve the intelligibility of the audio program.

18. The method of claim 17, comprising:

metering the center upmix signal to provide a value of intelligibility or loudness of the audio program.

19. The method of claim 18, comprising:

processing at least one of the signals of the audio program based on the value of intelligibility or loudness of the audio program to improve intelligibility or loudness, respectively, of the audio program.

20. The method of claim 17, wherein the upmixing of the left and right signals produces at least the center upmix signal and left and right upmix signals, the method comprising:

processing the center upmix signal, and downmixing at least the left and right upmix signals and the processed center upmix signal to obtain left and right downmix signals in which at least one of intelligibility or loudness has been adjusted over the left and right signals.

21. The method of claim 17, wherein the upmixing the left and right signals includes:

upmixing the left and right signals to obtain left and right upmix signals and at least one surround upmix signal that includes only non-anchor components of the audio program.

22. The method of claim 21, comprising:

processing at least one of the center upmix signal or the at least one surround upmix signal, wherein the processing includes at least one of:

equalizing the at least one surround upmix signal to preprocess the at least one surround upmix signal with an inverse frequency response of a filter found in consumer equipment as part of a hypersurround effect;

adjustably equalizing the center upmix signal or the at least one surround upmix signal;

adjustably varying the gain of the center upmix signal or the at least one surround upmix signal; and limiting the center upmix signal or the at least one surround upmix signal from exceeding a set threshold; and downmixing at least the left and right upmix signals and at least one of the processed surround upmix signal and the processed center upmix signal to obtain left and right downmix signals in which at least one of intelligibility or loudness has been adjusted over the left and right signals.

23. The method of claim 17, comprising:

processing at least one surround signal of the audio program, the processing including at least one of:

equalizing the at least one surround signal to preprocess the at least one surround signal with an inverse frequency response of a filter found in consumer equipment as part a hypersurround effect;

adjustably equalizing the at least one surround signal;

adjustably varying the gain of the at least one surround signal; and limiting the at least one surround signal from exceeding a set threshold.

24. A system for improving at least one of intelligibility or loudness of an audio program, the system comprising:

a matrix encoder configured to receive audio signals of the audio program including at least one of a) left/front and right/front signals or b) left and right signals each of which includes at least some anchor components of the audio program and to downmix the received audio signals to obtain left downmix and right downmix signals;

a matrix decoder configured to upmix the left downmix and right downmix signals to obtain at least a center upmix signal, which includes a majority of the anchor components of the audio program including at least some anchor components of the audio program that were included in the at least one of a) the left/front and right/front signals or b) the left and right signals;

a system output configured to provide the center upmix signal to process at least one of the signals of the audio program based on the center upmix signal to improve at least one of intelligibility or loudness of the audio program; and an adder configured to, to improve intelligibility of the audio program, add at least a portion of the center upmix signal to one or more of:

a) the left and right signals, and b) a center/front signal of the audio program.

25. The system of claim 24, comprising:

a meter operatively connected to the system output and configured to meter the center upmix signal to provide a value of intelligibility or loudness of the audio program.

26. The system of claim 25, comprising:

a processor configured to process at least one of the signals of the audio program based on the value of intelligibility or loudness of the audio program to improve intelligibility or loudness, respectively, of the audio program.

27. The system of claim 25, wherein the meter is compliant with at least one of:

EBU R128;

ITU-R BS.1770; and

ATSC A/85.

28. The system of claim 24, wherein the matrix decoder is configured to upmix the left downmix and right downmix signals to obtain at least the center upmix signal and left and right upmix signals.

29. The system of claim 28, comprising:

a processor configured to process the center upmix signal; and a second encoder configured to downmix at least the processed center upmix signal and the left and right upmix signals to obtain left and right downmix signals whose intelligibility or loudness is improved over intelligibility or loudness, respectively, of the left and right signals.

30. The system of claim 24, wherein the matrix decoder is configured to upmix the left downmix and right downmix signals to obtain at least the center upmix signal, a surround upmix signal and left and right upmix signals.

31. The system of claim 30, comprising:

a processor configured to process the center upmix signal; and a second encoder configured to downmix at least the processed center upmix signal, the surround upmix signal and the left and right upmix signals to obtain left and right downmix signals whose intelligibility or loudness is improved over intelligibility or loudness, respectively, of the left and right signals.

32. The system of claim 31, comprising:

a detector configured to detect whether at least one of a center/front signal or a surround signal is present among signals of the audio program;

at least one switch operatively connected to the detector and configured to pass the left/front and right/front signals to the system output if at least one of the center/front or the surround signal is present among the signals of the audio program, the at least one switch further configured to pass the left and right downmix signals if at least one of the center/front or the surround signal is not present among the signals of the audio program.

33. The system of claim 30, comprising:

a processor configured to preprocess the surround upmix signal with an inverse frequency response of a filter found in consumer equipment as part of a hypersurround effect; and a second encoder configured to downmix at least the processed center upmix signal, the surround upmix signal and the left and right upmix signals to obtain left and right downmix signals.

34. The system of claim 24, wherein the matrix encoder receives a center/front signal of the audio program, the system comprising:

a processor configured to process the center/front signal to improve at least one of the intelligibility or the loudness of the audio program, the processing including at least one of:

adjustably equalizing the center/front signal;

adjustably varying the gain of the center/front signal; and limiting the center/front signal from exceeding a set threshold.

35. The system of claim 24, wherein the matrix encoder receives at least one surround signal of the audio program, the system comprising:

a processor configured to process the at least one surround signal including at least one of:

equalizing the at least one surround signal to preprocess the at least one surround signal with an inverse frequency response of a filter found in consumer equipment as part a hypersurround effect;

adjustably equalizing the at least one surround signal;

adjustably varying the gain of the at least one surround signal; and limiting the at least one surround signal from exceeding a set threshold.

36. The system of claim 24, comprising:

a dialog enhancer configured to enhance dialog of the audio program based on the center upmix signal.

* * * * *